United States Patent [19]

Beier et al.

[11] 4,232,807

[45] Nov. 11, 1980

[54] SEALING CARRIER PACK FOR CANS WITH BEADED EDGE

[76] Inventors: Gerhard Beier, Eisseler Strasse 47, 3090 Verden-Davelsen; Wolfgang Matthies, Vionvillestrasse 10, 2800 Bremen, both of Fed. Rep. of Germany

[21] Appl. No.: 938,249

[22] Filed: Aug. 30, 1978

[30] Foreign Application Priority Data

Aug. 31, 1977 [DE] Fed. Rep. of Germany ..... 2739143

[51] Int. Cl.[3] ..... B65D 71/00

[52] U.S. Cl. ..... 224/45 A; 206/430; 206/151

[58] Field of Search ..... 224/45 A, 45 AA; 294/87.2, 87.28; 206/150, 142, 151, 509, 504, 503, 155, 192, 162, 427, 430, 821

[56] References Cited

U.S. PATENT DOCUMENTS

| | | | |
|---|---|---|---|
| 3,331,500 | 7/1967 | Poupitch | 206/151 |
| 3,633,962 | 1/1972 | Erickson | 294/87.2 |
| 3,938,656 | 2/1976 | Owen | 206/150 |
| 4,120,396 | 10/1978 | Mascia | 206/430 |

FOREIGN PATENT DOCUMENTS

| | | | |
|---|---|---|---|
| 521431 | 2/1956 | Canada | 206/162 |
| 1461733 | 1/1977 | United Kingdom | 206/430 |

*Primary Examiner*—Robert J. Spar
*Assistant Examiner*—Kenneth Noland
*Attorney, Agent, or Firm*—Hammond & Littell, Weissenberger and Muserlian

[57] ABSTRACT

A sealing carrier pack for cans with beaded edge or circumferential projection at least the end which is openable, where a flat frame having a carrying handle is provided with a plurality of attached receiving and sealing areas opposing each other in pairs, and at the outer edge of each receiving area is an elastic extension having an undercut adapted to the beaded edge for clamping engagement of the cans arranged with the beaded edges facing each other, and where an extended lip designed as a ring is provided at the inner edge of each receiving area opposing each other in pairs, so that the beaded edge of a can to be inserted is held on the receiving area between the outer undercuts and the inner extended lip.

10 Claims, 5 Drawing Figures

FIG. 3
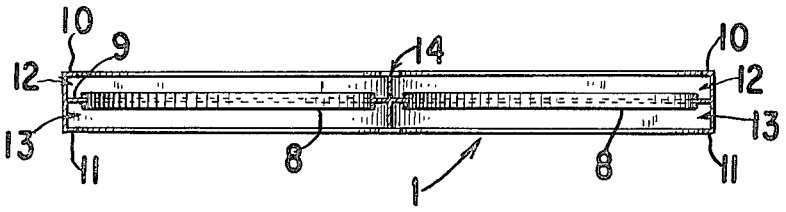
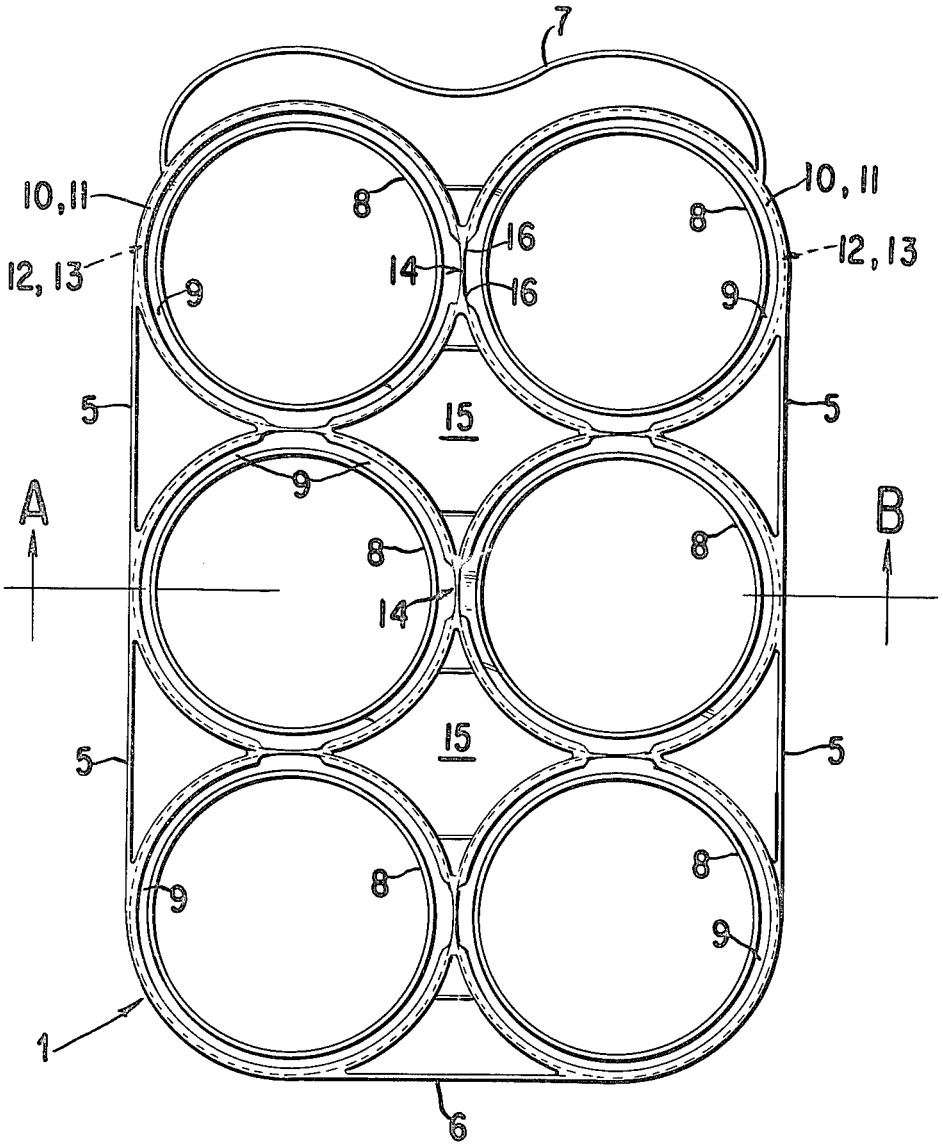
FIG. 2

SEALING CARRIER PACK FOR CANS WITH BEADED EDGE

BACKGROUND OF THE INVENTION

A packing arrangement for cans with beaded edges is already known from German Pat. No. 1,138,523. But here special cover-type parts are required to retain the cans on the beaded edge and for the sanitary covering of the openable side of the respective cans. The known arrangement is, therefore, expensive both because of the production costs and because of the material consumption.

OBJECTS OF THE INVENTION

An object of the present invention is to provide a pack carrier of the above-described type, where special covers for retaining the cans to be inserted or similar container with a circumferential projection are not required, but where a sanitary closure of the openable side of the respective can is likewise ensured.

Another object of the present invention is the development of a pack carrier for cans with a beaded edge or circumferential projection at at least one end, said cans having a recessed openable closure on said end having said beaded edge comprising a flat frame having a carrying handle, said flat frame being provided with a plurality of attached flat receiving and sealing areas opposing each other in pairs on the frame surface, said receiving and sealing areas having a flat surface of the dimension of the beaded edge of said can and an inner extended lip being adapted to extend into the recessed area of said can, said flat receiving and sealing areas being provided with outer extended elastic lips adapted to completely surround each of said cans beyond said beaded edge, said extended lips having a flange over said flat receiving and sealing area adapted to receive said beaded edge, whereby pairs of cans can be inserted therein and maintained in sealed and sanitary condition.

These and other objects of the present invention will be more apparent as the description thereof proceeds.

FIG. 2 shows a top view of the surface of the pack carrier of the invention.

FIG. 3 shows a cross-section along line A–B of FIG. 2.

Figure 4:
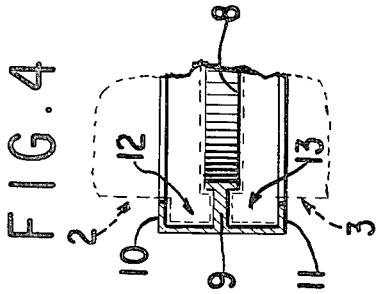
FIG. 4 shows an enlarged cross-section of part of line A–B.

The solution of the above objects according to the invention consists in that a plurality of receiving and sealing areas with extensions are combined to a single bodily unit for the insertion and direct retention of the beaded edges of a plurality of cans, that the outer edge of this unit comprises reinforcing ribs with a belt-type part surrounding all the receiving areas, and that flanges are provided inside the unit between the undercuts opposing each other in pairs which continue tangentially to the corresponding flanges of adjacent receiving areas with extensions in the area of the carrier forming a single unit.

More particularly, the present invention relates to a pack carrier for cans with a beaded edge or circumferential projection at at least one end, said cans having a recessed openable closure on said end having said beaded edge comprising a flat frame having a carrying handle, said flat frame being provided with a plurality of attached flat receiving and sealing areas opposing each other in pairs on the frame surface, said receiving and sealing areas having a flat surface of the dimension of the beaded edge of said can and an inner extended lip being adapted to extend into the recessed area of said can, said flat receiving and sealing areas being provided with outer extended elastic lips adapted to completely surround each of said cans beyond said beaded edge, said extended lips having a flange over said flat receiving and sealing area adapted to receive said beaded edge, whereby pairs of cans can be inserted therein and maintained in sealed and sanitary condition.

In the pack carrier according to the invention, the cans are principally so inserted in two planes that the can layers are arranged at both sides of the carrier. Because of the receiving areas with extensions which are enclosed within the beaded edges of the inserted cans on all sides, it is readily possible to achieve a sanitary closure of the openable end of the cans, which have a recessed openable closure with an optional drinking opening by inserting the cans with the openable end into the pack carrier. In other words, sanitary protection of the drinking opening at the openable end of the can is ensured in the carrier according to the invention without any additional cover.

Since the cans or other containers are combined in pairs, with the recessed openable closure and beaded edge opposing each other, the frame of the carrier is always between two cans or containers. The carrying handle attached on the frame is, therefore, always at the correct point with regards to the center of gravity of the entire packing unit.

While the drawings depict a pack carrier for cans or containers having a round circumference, other shapes of cans or containers may be employed. Efficient sanitary sealing of the recessed openable closure is still effected with containers having an oval cross-section or other types of cross-sections.

It is also of advantage if an outer surface extension with undercuts bordering the receiving and sealing area is provided in the new carrier so that the beaded edge of the respective can is supported between an undercut and an inner extended lip. The cans or other containers can then also be removed individually from the frame of the pack carrier.

The cans inserted into the new carrier need not be unpacked for selling, since the merchandise presents itself in the packing. The new pack carrier can thus be placed with the cans held by it either directly from the pallet on the shelf or be removed by the customer directly from the pallet. There are no wastes for the retailer. Since the cans or containers remain together in the pack carrier, pricing of each individual can is not necessary. In this sense it was found expedient to use the belt-type outer part of the unit according to the invention as a writing surface. The outer surfaces of the reinforcing ribs can be in the form of a circumferential belt integrated with the other part of the carrier to a unit which can also be used, for example, as data carriers for such items as type designation or pricing.

The belt-type part has, however, a third function as a unit of the carrier according to the invention. It can be designed or serve particularly on the narrow side of the carrier, as a carrying handle extending perpendicularly to the longitudinal axis of the cans and attached elastically to the pack. The belt-type part can bear flat on the end face of the carrier system without assuming a form projecting over the total width of the carrier system. This results in tight packing on the pallet or in any other transport system, as well as in optimum carrying comfort of the individual packing unit.

Figure 5:
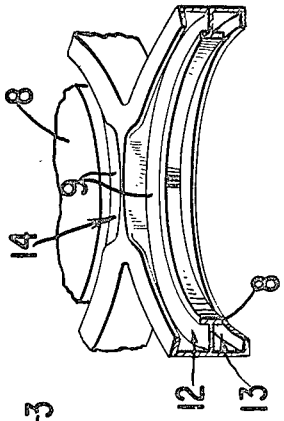
FIG. 5 shows an enlarged cross-section of part of line A–B at its junction point 14.

In order to facilitate the removal of individual cans, etc., from the pack carrier according to the invention, the undercuts and flanges can be eliminated on short sections at the contact points of two adjacent cans. At these points, however, the vertical extension connecting the undercuts and flanges with the annular receiving areas underneath remain, as is shown in FIG. 5. In another embodiment, part of this vertical extension may be removed to the area of the beaded edge of an inserted can. Despite the elimination of the undercut and flange at these points, a sanitary seal of the top side of the respective can inserted into the carrier is ensured.

Hollow spaces or holes can be provided in the surface of the pack carrier in the zone defined by three or four adjacent cans, which can serve as a safety device in stacking on pallets, e.g., by passing a mandrel therethrough.

The frame of the pack carrier can be cast, extruded or molded in one piece, from plastic, particularly polyolefin. It is preferable that the receiving area with inner extension and the outer vertical extension and flange with undercut be of an elastic nature. Compared to some of the present containers of this type, the new pack carrier has the advantage that it is waterproof and elastic. Since the new carrier consists substantially only of a flat frame, which can be made of lightweight plastic, this carrier has a relatively low weight and the transportation costs are, accordingly, low.

Other details will be described on the basis of the schematic drawing of one embodiment of the invention.

Figure 1:
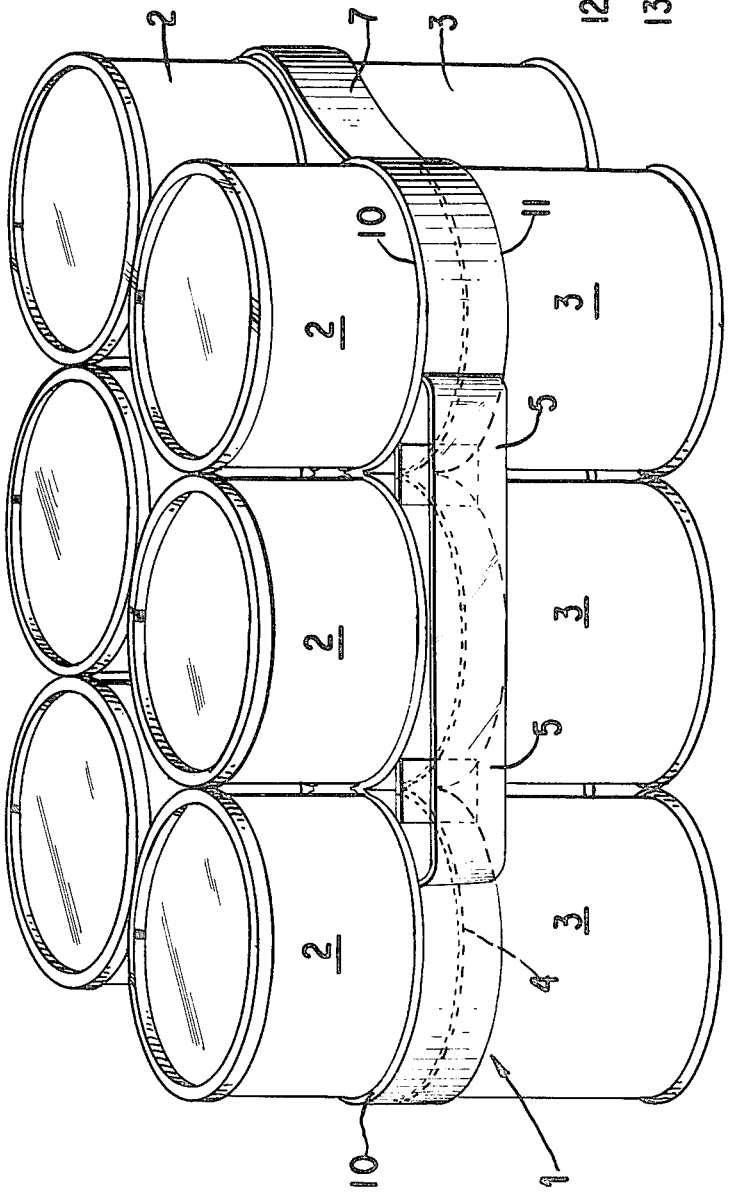
FIG. 1 shows a perspective side elevation of a filled pack carrier of the invention.

FIG. 1 shows a perspective side elevation of a filled pack carrier.

FIG. 2 shows a section parallel to the surface of the carrying frame of FIG. 1.

FIG. 3 shows a section along line A–B of FIG. 2.

FIG. 4 shows an enlarged cross-section of part of line A–B.

FIG. 5 shows an enlarged cross-section of part of line A–B at its junction point 14.

A set of cans 2 and 3 are inserted into frame 1 of the pack carrier according to FIG. 1 from the top and from the bottom. The cans are adjacent to each other approximately at the broken line. The beaded edges of the cans are clamped here by the device of the invention. The cross-section shown in FIG. 2, which extends parallel to the surface of frame 1 of FIG. 1, shows how the cans can be correlated to each other in frame 1.

Frame 1, according to FIG. 2, has at the edge reinforcing ribs or vertical extensions 5, 6 and 7, which form a circumferential belt, which is integrated with the frame to a single part. The belt-type reinforcing ribs can be tightened—we refer here to the reinforcing ribs 5 and 6—or be attached loosely on the can surfaces and be removed again. The latter case is indicated by the belt-type part 7, which is designed as a relatively soft-carrying handle. The other parts of the circumferential belt-type reinforcing ribs can be used readily as data carriers, for example, for pricing.

The drawing in FIGS. 1 to 5 shows a frame with six receiving areas 9 with extensions 8 on each frame surface for the insertion of 2×6, hence 12 cans. The edge of extensions 8 is so designed that it is suitable for the clamping, detachable engagement of cans or other containers to be inserted, which cans or containers have a recessed openable closure sufficiently recessed to receive the extensions 8. Frame 1, according to FIGS. 2 and 3, consists of several receiving rings 9 surrounding extensions 8, held together at several points, at the outer edges of which (on both surfaces) are provided flanges 10 and 11 with undercuts 12 and 13 for engaging the cans to be inserted. On the inside of flanges 10 and 11, arranged at both sides on the plane surface of frame 1, the undercuts 12 and 13 are arranged, which are spaced so far from the surface of rings 9 that the respective beaded edge of the can to be inserted in the frame can just be clamped between undercuts 12, 13 and the surface of ring 9, with extension 8 extending into the recessed openable closure of the can.

In order to ensure a tight packing of the cans, etc. in the carrier according to the invention, it is advisable to design flanges 10, 11 so that the cans can be placed without distance in the range of the beaded edges. This is achieved, according to the invention, in this way so that flanges 10 and 11 surrounding a receiving area 9 and the corresponding flanges surrounding an adjacent receiving area penetrate each other tangentially, forming a single unit. In these penetration zones 14 in the face of the carrier of adjacent receiving disks, the material of the vertical extension 16 is thus not thicker than on the rest of the circumference of the flange with undercut. The vertical extension, however, should be just high enough in the penetration zones 14 so that it ensures a sanitary seal of the face of the can inserted into the carrier.

The handling and manufacture of the pack carrier according to the invention are facilitated if the undercuts 12, 13 in the penetration zones 14 of two adjacent receiving positions are eliminated on a short section. In this short section, the beaded edges of the inserted cans or other containers are then only engaged on the circumference by a straight vertical extension 16. This facilitates, particularly, the removal of the inserted cans, which can be pulled out by simply tipping them out of the carrier against the elastic force of the flanges and undercuts.

Depending on the type, shape, number and cross-section of the cans, etc. to be packed, the design of the new pack carrier can be changed. The latter is influenced particularly by the dimensions of the beaded edge or any other projection permitting engagement. Since the anchoring principle is based on the flanges and undercuts and an opposite position of the packed cans is always provided, a material-saving design of the pack carrier is obtained, particularly since they support each other in the tight unit. The pack carrier is always between at least two cans etc. arranged head to head. This mutual support of the cans to be combined influences, likewise, the design of the frame.

As it can be seen particularly from FIG. 2, hollow spaces 15 can be provided inside the frame. These hollow spaces 15, which can also be round, can be used with advantage as a safety device in stacking on pallets by passing a mandrel or bar through the hollow spaces 15 of stacked pack carriers according to the invention.

The drawing relates to a pack carrier with 2×6, hence 12 receiving faces for the insertion of cans, etc. Naturally, it is also possible to design pack carriers on the same principle which have, for example, 2×5 or any other number of receiving disks or extensions.

The preceding specific embodiments are illustrative of the practice of the invention. It is to be understood, however, that other expedients known to those skilled in the art, or disclosed herein, may be employed without departing from the spirit of the invention or the scope of the appended claims.

We claim:

1. A pack carrier for cans having a substantially round cross-section with a beaded edge or circumferential projection at at least one end, said cans having a recessed openable closure on said end having said beaded edge comprising a flat frame having a carrying handle of extruded plastic, said flat frame being provided with a plurality of attached flat receiving and sealing areas opposing each other in pairs on the frame surface, said receiving and sealing areas having a flat surface of the dimension of the beaded edge of said can, said flat receiving and sealing areas being provided with outer extended elastic lips adapted to completely surround the outer beaded edges of said cans and bear upon them, said extended lips having a flange or bulge over said flat receiving and sealing area adapted to receive said beaded edge where the beaded edge is touched only below, laterally and on the top edge, one of said outer extending elastic lips of one of said flat receiving and sealing areas extending to and merging into the outer extending elastic lip of another of said flat receiving and sealing areas adjacent thereto tangentially, wherein, in one of said outer extended lips which extends to and merges with another of said outer extended lips adjacent thereto tangentially, said flange or bulge does not extend in the area tangential to two of said extended lips where at this tangential point and for a short distance on each side thereof said adjacent extended lips merge to one extended lip without a flange or bulge on either side thereof forming a vertical extension, said vertical extension at said tangential point being reduced in height to below the elevation of the beaded edge of the cans, the thickness of the extended lips at said vertical extension being such that the walls of said cans at the tangential points practically touch and support each other in a tight unit, whereby pairs of cans can be inserted therein and maintained in sealed and sanitary condition.

2. The pack carrier for cans of claim 1 adapted for cans having a round cross-section.

3. The pack carrier for cans of claim 1 wherein said circular outer extended lips are connected tangentially along the outside of said flat frame by an extended belt as a reinforcing means.

4. The pack carrier for cans of claim 3 wherein said extended belt reinforcing means presents a flat outer surface adapted to carry indicia.

5. The pack carrier for cans of claim 4 wherein said carrying handle is attached elastically to said extended belt reinforcing means, extending perpendicularly to the longitudinal axis of the attachable cans when attached to said pack carrier.

6. The pack carrier for cans of claim 5 wherein said carrying handle extending perpendicularly to the longitudinal axis of the attachable cans when attached to said pack carrier has a curved form following the outer contour of the carrier, which has the effect by its special form that the carrying handle bears in a space-saving manner on the can carrier at the slightest counter-pressure, forming no lateral projection over the outer edge of the carrier.

7. The pack carrier for cans of claim 1 wherein said plastic is polyolefin.

8. The pack carrier for cans of claim 1 wherein one or more holes are present in said flat frame outside said extended lips adapted to completely surround each of said cans, said holes being adapted for stacking said carrier.

9. The pack carrier for cans of claim 1 wherein said receiving and sealing area having a flat surface of the dimension of the beaded edge of said can extends inwardly towards the center of the cross-section of said can beyond the beaded edge of said can and terminates in an inner extended lip being adapted to extend into the recessed area of said can.

10. The pack carrier for cans of claim 1 wherein said outer extending elastic lips having a flange or bulge over said flat receiving and sealing area form a conical cross-sectional profile in the range of the lateral development of the beaded edge of the cans, whereby a limited elastic constant pressure bears against the upper part of the beaded edge of the can in the direction of said flat receiving and sealing areas and a particularly firm seal of the cans in the pack carrier is ensured.

* * * * *